US007458470B2

(12) United States Patent
Jerstroem et al.

(10) Patent No.: US 7,458,470 B2
(45) **Date of Patent: *Dec. 2, 2008**

(54) RACK WITH PIVOTING FINGERS

(75) Inventors: Goeran Jerstroem, New York, NY (US); Boris Kontorovich, Brooklyn, NY (US); Alec Drummond, Brooklyn, NY (US); Arsenio Garcia Monsalve, New York, NY (US); Sally Bernadine Rumble, New York, NY (US); Steven Dibdin, Brooklyn, NY (US); Conor P. McNamara, Brooklyn, NY (US)

(73) Assignee: Helen of Troy Limited, St. Michael (BB)

( * ) Notice: Subject to any disclaimer, the term of this patent is extended or adjusted under 35 U.S.C. 154(b) by 0 days.

This patent is subject to a terminal disclaimer.

(21) Appl. No.: 11/881,648

(22) Filed: Jul. 27, 2007

(65) Prior Publication Data

US 2007/0272632 A1 Nov. 29, 2007

Related U.S. Application Data

(63) Continuation of application No. 10/340,120, filed on Jan. 10, 2003.

(51) Int. Cl.
*A47G 19/08* (2006.01)

(52) U.S. Cl. ..... 211/41.4; 211/41.6

(58) Field of Classification Search ..... 211/41.5, 211/41.6, 41.2, 41.3, 184, 175; 248/346.03, 248/346.5; D32/55, 56; 15/203
See application file for complete search history.

(56) References Cited

U.S. PATENT DOCUMENTS

| | | | |
|---|---|---|---|
| 253,461 | A | 2/1882 | Wold |
| 378,692 | A | 2/1888 | Latham |
| 946,977 | A | 1/1910 | Muller |
| 1,006,328 | A | 10/1911 | Widenhofer |
| 1,522,921 | A | 1/1925 | Smiley |
| 1,835,232 | A | 12/1931 | Lord |
| 1,997,451 | A | 4/1935 | Burkle |
| 2,443,404 | A | 6/1948 | Tallarico |
| 2,479,118 | A | 8/1949 | Jenness |
| 2,516,088 | A | 7/1950 | Einhorn |
| 2,777,488 | A | 1/1957 | Gilbert et al. |
| 3,025,967 | A | 3/1962 | Christophersen |

(Continued)

OTHER PUBLICATIONS

Photocopy of Munchkin Bottle Drying Rack (admitted prior art).

(Continued)

*Primary Examiner*—Jennifer E. Novosad
(74) *Attorney, Agent, or Firm*—Seyfarth Shaw LLP

(57) ABSTRACT

The present invention provides a rack including fingers which are pivotally mounted so that when an actuator is moved to an extended condition the fingers will simultaneously move to an extended position approximately perpendicular to the upper surface of the rack so that items may be placed thereon for uses such as drying. The fingers are pivotally attached to the actuator so that, upon movement to a retracted position, the fingers will pivot downward and to a retracted position below the upper surface providing a flat rack that is easily stored. The rack also includes a liquid indicator for identifying whether liquid is present within a base of the rack.

6 Claims, 3 Drawing Sheets

U.S. PATENT DOCUMENTS

| | | | | | |
|---|---|---|---|---|---|
| 3,146,815 | A | | 9/1964 | Cirese | |
| 3,730,354 | A | | 5/1973 | Bronstein | |
| 3,800,957 | A | | 4/1974 | Krause | |
| 3,934,728 | A | | 1/1976 | Guth | |
| 3,952,875 | A | | 4/1976 | Lombardo | |
| 4,046,261 | A | | 9/1977 | Yake | |
| 4,103,387 | A | * | 8/1978 | Anetseder et al. | 15/203 |
| 4,137,596 | A | * | 2/1979 | Carlson et al. | 15/203 |
| 4,169,638 | A | | 10/1979 | Cirasuolo et al. | |
| 4,202,361 | A | * | 5/1980 | Bills | 132/123 |
| 4,212,400 | A | | 7/1980 | Buchsteiner | |
| 4,221,299 | A | | 9/1980 | Taylor | |
| 4,238,035 | A | | 12/1980 | Kasanchuk | |
| 4,328,899 | A | | 5/1982 | Krusche | |
| 4,494,269 | A | * | 1/1985 | Makabe | 15/203 |
| 4,498,211 | A | | 2/1985 | Bottolfson | |
| 5,815,877 | A | * | 10/1998 | Heneveld | 15/203 |
| 6,070,594 | A | | 6/2000 | Mears | |
| D429,863 | S | | 8/2000 | Lenney | |
| 6,125,548 | A | | 10/2000 | Dunn et al. | |
| 6,170,676 | B1 | | 1/2001 | Patadia et al. | |
| 6,179,134 | B1 | | 1/2001 | Pine et al. | |
| D439,716 | S | | 3/2001 | Wright | |
| 6,272,827 | B1 | | 8/2001 | Hsu | |
| 6,477,732 | B1 | * | 11/2002 | Cline et al. | 15/185 |

OTHER PUBLICATIONS

Photocopy of Magis rack (admitted prior art).

* cited by examiner

RACK WITH PIVOTING FINGERS

CROSS REFERENCE TO RELATED APPLICATION

This application if a continuation of U.S application Ser. No. 10/340,120, filed Jan 10, 2003.

The present invention pertains to a rack with pivoting fingers and in particular a rack including fingers that may be pivoted between retracted and extended positions for supporting articles thereon.

BACKGROUND

Racks for supporting articles such as bottles and dishes and having pegs or fingers to support articles thereon for drying are well known. Such racks generally have a base for catching water and supporting articles that are placed either on or between the fingers. Such racks have been formed of wires with pivoting hinges so that the entire rack may be folded and stored conveniently.

Other racks have a rigid base with fingers which are mounted on the base to be pivoted to move between a retracted and extended position. Such an arrangement is shown in U.S. Pat. No. 6,125,548. However, the movement of the fingers is very time consuming in that each row of fingers must be grasped one by one and moved between the retracted and extended positions. As well, in the retracted position the rack fails to provide a smooth, unencumbered upper surface. Finally, such a rack fails to provide a mechanism by which all of the fingers may be moved simultaneously between a retracted and extended position via actuation by a single hand of an operator making a single motion. The present invention provides such an invention that overcomes the above-mentioned disadvantages.

SUMMARY

The present invention provides for a rack for supporting articles, the rack comprising a base having an upper surface and a lower surface. The upper surface has a plurality of holes therein. An actuator is mounted between the surfaces and has a plurality of fingers movably attached thereto and respectively extendable through the holes. The actuator is movable between extended and retracted conditions. The fingers are responsive to movement of the actuator to its extended condition for simultaneously moving the fingers to extended positions, protruding from the holes approximately perpendicular to the upper surface. The fingers are responsive to movement of the actuator to its retractable condition for simultaneously moving the fingers to retracted positions recessed below the upper surface. In an embodiment the fingers may be received by guide channels formed adjacent the holes. The fingers may be attached to a plurality of rods. The rods may be oriented in rows spaced within the base. The rods are attached to the actuator which includes a handle exposed at a side of the base. Upon sliding the handle from a closed condition, where the handle is adjacent an edge of the side, to an open condition where the handle is extended from the side, the rods slide through the base and the fingers slide through the guide channels and pivot from the retracted position to the extended position. In an embodiment, the actuator may be slidable and carries the fingers thereon in order to move between the extended condition and the retracted condition. In an embodiment the lower surface and the actuator may be attached to and activate the fingers in a simultaneous manner. In an embodiment, each finger may be slidingly received in the guide channels formed in the upper surface of the base. In an embodiment, each hole may include an extending edge and a retracting edge that abuts the fingers and, upon sliding of the actuator, the fingers engage the edges to either extend or retract the fingers.

In an embodiment, the actuator may include a rectangular frame formed by a pair of sliders at each side, a handle at an end and an enclosed edge at the end opposite the handle. In an embodiment, a plurality of rods may be provided between and perpendicular to the sliders. In an embodiment, a web may be formed and attached to the rods and each finger may include a proximal end attached to a rod so that, upon sliding of the actuator to the retracted condition, the web carries each rod and causes each finger to pivot and rotate from the extended position toward the retracted position. In an embodiment, the actuator may include a tab protruding therefrom in order to engage a protrusion formed in the base so that, upon sliding of the actuator to the extended condition, the tab engages the protrusion in order to lock the sliding member in the extended condition. In an embodiment, the tab is associated with a latch member so that, upon depression of the latch member, the tab disengages the protrusion so that the sliding member may return to the retracted condition. In an embodiment, the tab may be provided at a first end of a pivot arm and the latch member is provided at a second end of the pivot arm and the pivot arm is pivotally mounted to the actuator and includes a spring to urge the pivot arm to an extended condition with the tab protruding from the side. In an embodiment, the pivot arm includes a pivot point provided intermediate to the tab and the latch member so that the pivot arm is mounted at the pivot point so that upon sliding the actuator from the retracted condition to an extended condition a ramped surface of the tab slidingly abuts against the protrusion causing the pivot arm to pivot so that the tab moves away from the protrusion, allowing the actuator to slide past the protrusion to the extended condition, whereupon the tab and pivot arm may move outward into a locked condition with a flat edge of the tab abutting the protrusion. In an embodiment, a stop abutment is provided to limit outward movement of the actuator in the retracted condition.

The present invention further provides a method of moving a rack between a flat folded orientation and a splayed, unfolded orientation for supporting articles thereon, comprising the steps of providing a base having an actuator having a plurality of fingers pivotally attached thereto, sliding the actuator so that the fingers are in a retracted position below a top surface of the base and adjacent holes formed in the top surface. Sliding the actuator so that it extends beyond an edge of the base and pivoting the fingers so that they slide through the holes and extend to an upright position approximately perpendicular to the top surface. In an embodiment, the method may comprise the step of activating a latch member in order to slide the actuator to the retracted condition. In an embodiment, the method may comprise the actuator including rods pivotally attached to the fingers so that the fingers may pivot up and out of the holes when the actuator is moved. In an embodiment, the method may further comprise the steps of sliding the actuator toward the retracted condition and carrying each finger to a position so that each finger abuts against a retracting edge of the holes, moving the actuator to the retracted condition, the fingers engaging the retracting edge and pivoting the finger to the retracted position. In an embodiment, the method may further comprise the steps of sliding the actuator toward the extended condition and carrying each finger to a position so that each finger abuts against an extending edge of the holes, moving the actuator to the extended condition, the fingers engaging the extending edge and pivoting the fingers to the extended position.

The present invention may also comprise a pivoting assembly for moving a finger between an extended and retracted position comprising a finger pivotally mounted to a base, an upper surface having a hole for receiving the finger therethrough, an extending surface and a retracting surface attached to the upper surface and an actuator causing the extending surface to abut the finger in order to pivot the finger to an extended position and the actuator causing the retracting surface to abut the finger in order to pivot the finger to the retracted position. In an embodiment, the base may be formed of a web forming the actuator. In an embodiment, the upper surface and actuator may be formed together and slide along the base. In an embodiment, the upper surface and base may form a cavity for slidingly receiving the actuator therein. In an embodiment, the extending surface may form a semicircular side of a hole and the retracting surface may form a semicircular side of the hole opposite the extending side and the hole is formed in the upper surface and receives the finger. In an embodiment, the retracting surface is approximately coplanar with the upper surface and the extending surface is oriented approximately between the upper surface and the base.

In a further embodiment the present invention provides a rack comprising a first member having fingers moveably attached thereto. A second member is provided for receiving the fingers therethrough and the first and second members are coupled for relative movement to each other between a first condition and a second condition. The fingers are responsive to the relative movement so that in the first condition the fingers are in a retracted position and in the second condition the fingers are in an extended position. In an embodiment, the first and second members may form a housing and the first member slides relative to the housing and the fingers are pivotally attached to the first member so that upon sliding of the first member the fingers pivot between the extended and retracted position. In an embodiment, the first and second members may form a housing and the second member slides relative to the housing. The fingers are pivotally attached to the first member so that upon sliding of the second member the fingers pivot between the extended and retracted position. In an embodiment, a cavity may be provided and the first member may include an actuator that slides within the cavity. The actuator has the fingers pivotally mounted thereto. In an embodiment, the actuator may slide between the first condition where the actuator is retracted within the cavity and the second condition where the actuator is extended from the cavity. In an embodiment, the second member may include an upper surface having an extending surface and a retracting surface corresponding to each finger so that when the fingers are received through the upper surface of the second member, each finger is adjacent to each of the extending surfaces and the retracting surfaces. In an embodiment, upon movement to the first condition each retracting surface may act on each finger in order to move the fingers to the retracted position. In an embodiment, the upper surface may include a plurality of holes and each hole may include the retracting surface formed therein. In an embodiment, upon movement to the second condition each extending surface may act on each finger in order to move the fingers to the extended position. In an embodiment, the upper surface may include a plurality of holes and each hole may include the extending surface formed therein.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF PRESENTLY PREFERRED EMBODIMENTS

Figure 1:
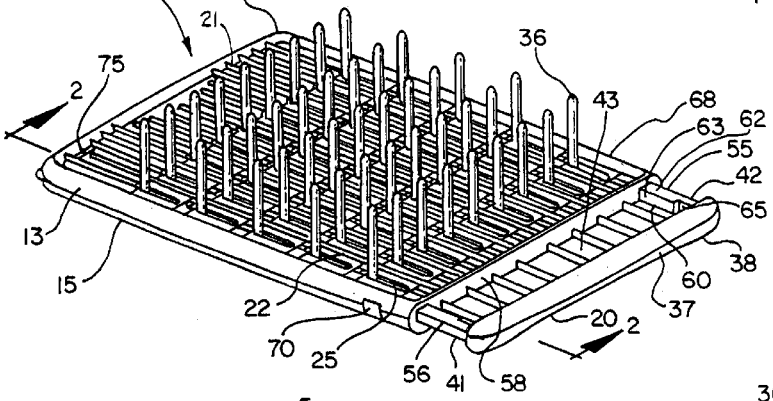
FIG. 1 is a perspective view of a rack of the present invention in its extended position.
Figure 3:
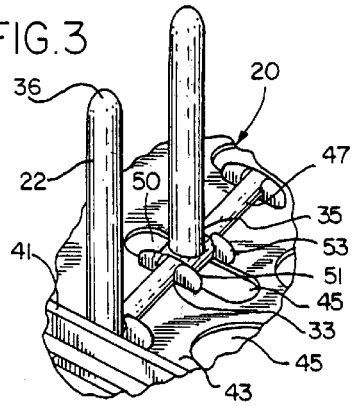
FIG. 3 is an enlarged fragmentary perspective view of Section A of FIG. 2.
Figure 2:
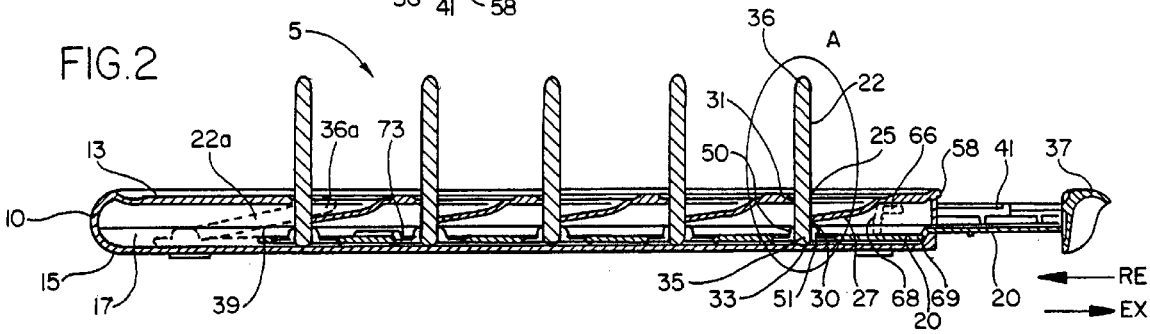
FIG. 2 is an enlarged sectional taken at line 2-2 of FIG. 1.

An embodiment of the invention is described with respect to FIGS. 1-4. A rack 5 is provided, for example a dish rack, including a base 10 having a first member or upper surface 13 and a second member or lower surface 15. An actuator 20 is mounted within the base 10 between the upper and lower surfaces 13 and 15. In an embodiment, the upper surface 13 is disposed on a top half and the lower surface 15 is disposed on a bottom half for defining therebetween a cavity 17 for receiving the actuator 20 therein. Formed in the upper surface 13 are plurality of ribs 21 providing upstanding protrusions for plates or other articles to rest against when placed on the rack 5. The cavity 17 may include a water draining means 18, such as a tube extending from the lower surface 13 (see FIG. 4). Pivotally mounted to the actuator 20 are a plurality of fingers 22. The fingers 22 are formed generally in parallel rows and respectively protrude through holes 25 formed in the upper surface 13 of the base 10. Each hole 25 is formed adjacent a guide channel 27. In a preferred embodiment each hole 25 cooperates with an edge of its associated guide channel 27 generally to form a semicircular lower surface that acts as an extending edge 30 and an opposing semicircular upper surface forming a retracting edge 31. As shown in FIG. 2, the retracting edge/surface 31 is approximately coplanar with the top face of the upper surface 13 and the extending edge/surface 30 is depressed below the upper face and is approximately midway between the upper surface 13 and a base point 33, where a proximal end 35 of the associated finger 22 is mounted to the actuator 20. Each finger 20 includes a distal end 36. As will be discussed in greater detail below, the extending edge 30 abuts the finger 22 and upon movement of the actuator 20, in direction of arrow EX, to an extended condition will cause the finger 22 to pivot to an extended position as shown in FIG. 2. The retracting edge 31 abuts the finger 22 so that, when the actuator 20 is moved in the opposite direction (arrow RE) to a retracted condition, the retracting edge 31 will cause the finger 22 to pivot and move to a retracted position.

In a preferred embodiment, the actuator 20 is formed of a rectangular frame 38 including a handle 37 and, at an opposite end, an rear edge 39 (see FIG. 2). Extending between the handle 37 and rear edge 39 are a pair of sliders 41, 42. In a preferred embodiment, the actuator 20 is formed of a bottom wall, such as a web 43, having apertures 45 formed therein. Mounted to the actuator 20 are ganged rows of fingers 22. The fingers 22 of each row are joined by a rod 47. In a preferred embodiment, nine fingers 22 are attached to each rod 47. Five rods 47 are mounted to the actuator 20 in a preferred embodiment in order to form a rack having forty-five fingers 22 (FIGS. 1 and 2). Four rods are mounted within the base 10 in the embodiment of FIG. 4 to form a rack having thirty-six fingers 22. In a preferred embodiment, as will be discussed in more detail below, all of the fingers 22 are moved simultaneously upon movement of the actuator 20 between its extended and retracted conditions. However, any number of fingers 22 per rod 47 may be provided; and any number of rods 47 may be mounted to an actuator 20.

In a preferred embodiment, pairs of brackets 50, 51 are formed on the web 43 of the actuator 20 in order to retain the rods 47 therein. In a preferred embodiment, the actuator is formed of a polymer material, such as a plastic, and the brackets 50, 51 are sufficiently resilient so that the rod 47 may be snapped in place between the pair of brackets 50, 51 (see FIG. 3) to retain the rod 47 against translational movement, but accommodate pivotal movement. In a preferred embodiment, a series of the pairs of brackets 50, 51 are oriented along the actuator 20 so that a pair of brackets 50, 51 are on each side of the proximal end 35. The end rod 47 has an enlarged diameter boss 53 at the proximal end 35 of each finger 22 disposable between adjacent pairs of brackets 50, 51. In a preferred embodiment, the fingers 22 and rods 47 are integrally molded forming individual rows of fingers 22. Therefore, it may be understood that, upon rotation of one finger 22, the entire row of fingers 22 will move simultaneously, in that they are all connected via a single rod 47. As well, other means of pivotally mounting the fingers 22 to a base point 33 or actuator 20 may be provided other than via a rod 47 or brackets 50, 51. For example, each individual finger 22 may be pivotally mounted to the actuator without any structure joining the rows of fingers 22.

In a preferred embodiment, a boss 53 is formed where the proximal end 35 of each finger 22 attaches to the rod 47. The boss 53, in a preferred embodiment, is a cylindrical portion having a diameter slightly larger than the diameter of the cylindrical rod 47. The boss 53 adds a rigid structure and strengthens the connection between the fingers 22 and the rod 47 and restricts longitudinal movement of the rod 47. Apertures 45 are formed in the web 43 of the actuator 20 so that, upon pivoting of the fingers 22 and rods 47, the bosses 53 may protrude downward through the apertures 45 without providing a frictional resistance against the surface of the web 43 (see FIG. 3).

The actuator 20 includes latch members 55, 56 in order to lock and/or latch the actuator 20 to or from its extended condition as shown in FIGS. 1 and 2. In the extended condition, the handle 37 is separated a distance from a first edge 58. Latch members 55, 56 may be actuated in order to move the handle 37 from its extended condition to a retracted condition where the handle 37 abuts the first edge 58. In a preferred embodiment, the latch members 55, 56 include a pivot arm 60 mounted to the slider 42 at a pivot point 62. The pivot arm 60 includes a first end 63 and a second end 65 (see FIG. 1). Attached to the first end 63 is a tab 66 (FIG. 2) which may abut a protrusion 68 formed on the base 10. The pivot arm 60 is spring mounted so that upon depression of the first end 65, the pivot arm 60 will pivot on pivot point 62 so that the first end 63 moves away from the protrusion 68 so that the handle 20 may be moved toward the first edge 58 in order to move the actuator 20 to its retracted condition. After actuation of the latch members 55, 56, the actuator 20 is moved in direction of arrow RE, the rods 47 and fingers 22 are also carried in direction of arrow RE, and the fingers 22 abut against retracting edges 33 of the holes 25 formed in the upper surface 13 of the base 10. As the actuator 20 is continued to be moved in direction of arrow RE, the fingers 22 will pivot in a clockwise direction as the fingers 22 abut retracting edge 31 causing the fingers 22 to retract within the holes 25 and to be received adjacent the guide channels 27. When the actuator 20 is completely retracted, so that the handle 37 abuts the first edge 58, the fingers will be oriented in a fully retracted position 22*a* with its distal end 36*a* retracted below the upper face of the upper surface 13 (see FIGS. 2 and 4). In this retracted condition it may be understood that the rack can be easily transported and stored in a small area.

In order to extend the fingers 22, the process discussed above is reversed and the handle 37 is grasped at a depression 57 (see FIG. 4) and pulled away from the first edge 58 in direction of arrow EX (see FIG. 2). As the handle 37 is pulled in direction of arrow EX, the actuator 20 is moved simultaneously along with the web 43 and rods 47 and fingers 22 carried thereby. The fingers 22 will slide along the guide channels 27 and be pivoted in a counterclockwise direction as the fingers 22 abut the extending edges 30 of the holes 25 in the upper surface 13 of the base 10. As the handle 37 is continued to be extended and pulled in direction of arrow EX, the fingers 30 will pivot up and out of the holes 25 so that they are extended in a position approximately 90° to the upper face of the upper surface 13.

Figure 4:
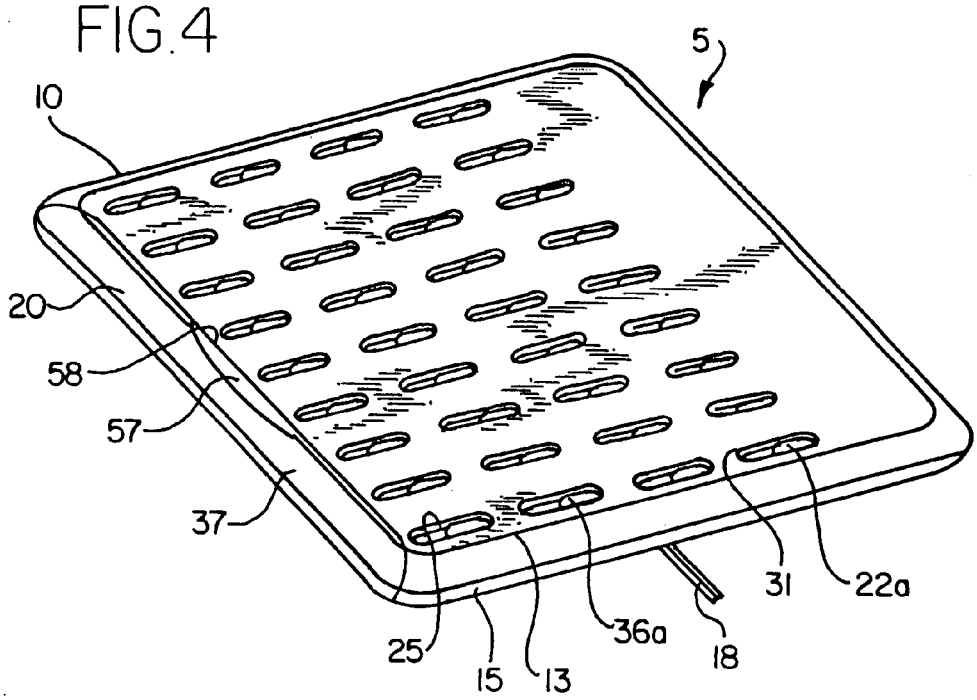
FIG. 4 is a perspective view of an alternate embodiment of the invention in a retracted position.
Figure 5:
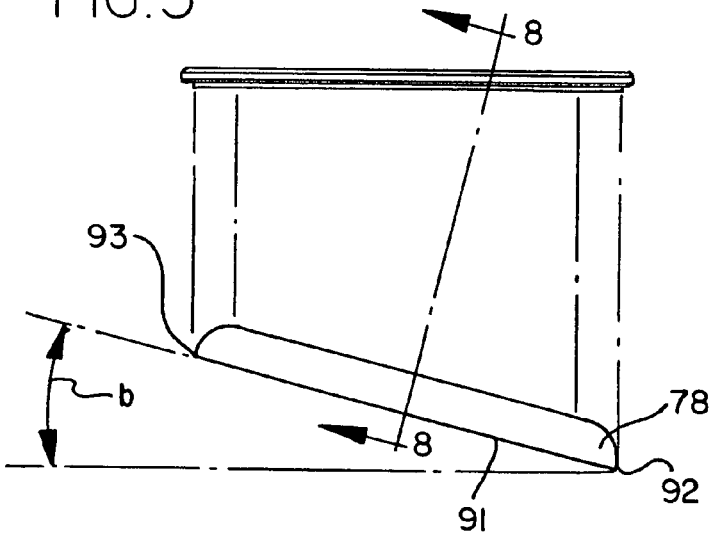
FIG. 5 is a side view of a prism of the present invention.
Figure 7:
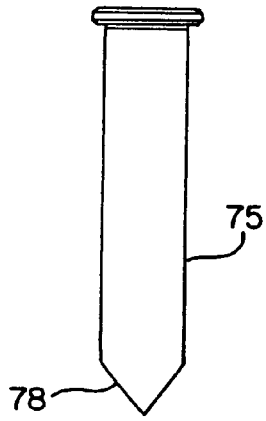
FIG. 7 is an end view of the prism of FIG. 5.
Figure 6:
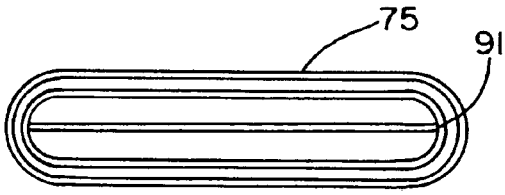
FIG. 6 is a bottom view of the prism of FIG. 5.

When the handle 37 is fully extended, the latch members 55, 56 will be actuated to lock the handle 37 in its extended condition. The first end 63, in a preferred embodiment, having a tab 66 will slide so that a ramped surface on the tab 66 will abut a protrusion 68 within the base. The pivot arm 60 will pivot outward so that the tab 66 may slide past the protrusion 68 and then the tab 66 will snap to a locked position where a flat edge of the tab 66 abuts against the protrusion formed within the base 10. A flat edge 69 of the actuator 20 will act as a stop abutment, abutting against the first edge 58 of the lower surface 15 (see FIG. 2). Simultaneously, the spring of the latch member 55, 56 maintains the pivot arm in a latched position so that the actuator 20 will be maintained in its extended condition. Each protrusion 68 is formed in the sides of the base 20 adjacent the sliders 41, 42. In an alternate embodiment, a latch member 70 may be provided to be activated from the outside of the rack. In the extended position a return member, for example a preloaded spring 73 helps to return the actuator 20 to its retracted position by moving the actuator 20 slightly in direction of arrow RE upon release of latch 60 to pull the tab 66 past the protrusion 68. The actuator 20 may be pushed with a hand to be moved to the fully retracted position (FIG. 4).

Figure 8:
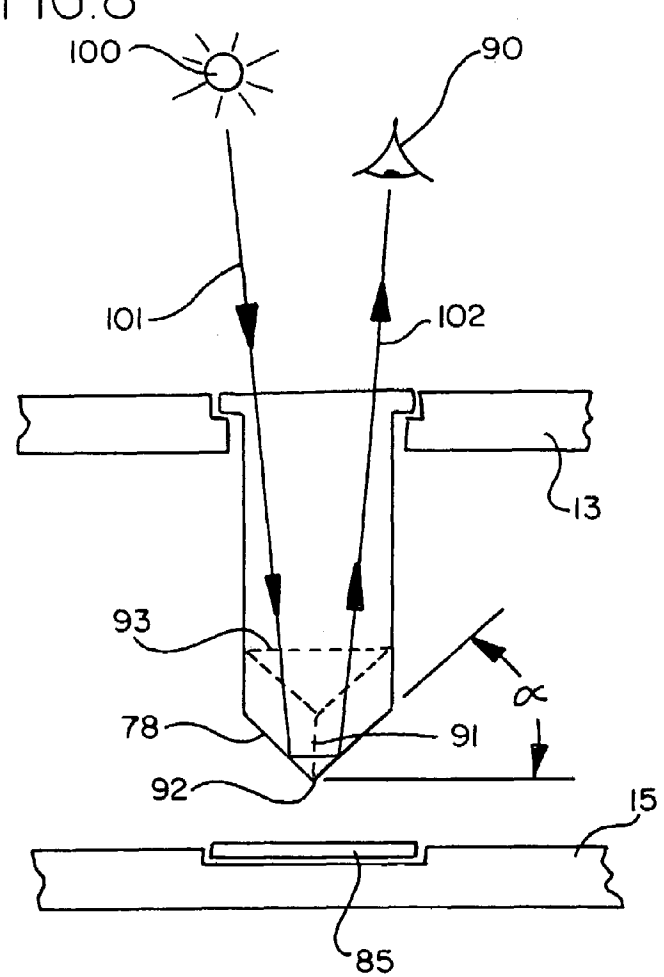
FIG. 8 is a sectional view of the prism of FIG. 5 taken at line 8-8 and shown mounted in a rack without water.

In a preferred embodiment, the base 10 also includes a translucent prism 75 (see FIGS. 1 and 5-9) which acts as a liquid indicator to allow one to visually inspect whether the base 10 has collected any water. In an embodiment, the prism 75 is formed having a beveled end 78 to reflect light, so that without water touching the beveled end 78 the prism 75 appears opaque (see FIG. 8). When water is present (see FIG. 9) the beveled end 78 is covered by water 80 that acts as a transmission media causing the beveled end 78 of the prism 75 to become translucent allowing a colored surface 85 directly below the prism 75 to illuminate the prism and transmit the tight to a users eye 90. For example, a red stripe 85 may be provided below the prism 75 that becomes visible when water 80 contacts the beveled end 78 of the prism.

In an alternate embodiment the colored surface may be white, black, orange, yellow, green, blue, violet or any other color. In an embodiment, a light source 100 transmits light rays 101 into the prism 75. When liquid or water 80 is not present at the beveled end 78 (see FIG. 8) the light ray is reflected by the beveled end 78 due to the difference in the index of refraction between the prism 75 and the air adjacent the beveled end 78. In an embodiment, the prism 75 is formed of a polycarbonate. The light ray 101 is reflected as light ray 102 which appears white or opaque to a user's eye 90. When liquid or water 80 is present and covers a portion of the beveled end 78, a transmission media is present having an index of refraction close to the prism 75, so that the light ray 101 is transmitted through the water 80 to the base 15 and reflects the colored surface 85 as a light ray 103 (see FIG. 9).

Figure 9:
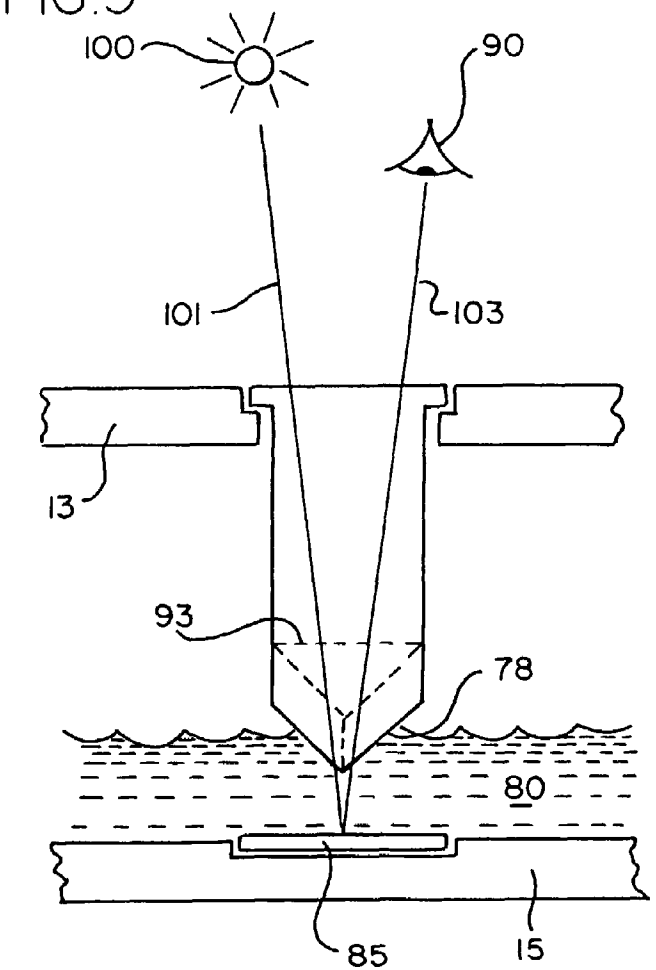
FIG. 9 is the prism and rack of FIG. 8 shown with water present.

In an embodiment, the beveled end 78 may have an angle "a" of approximately 45°. In an embodiment, an apex 91 of the beveled end 78 may be slanted at an angle "b" of approximately 10-30° from the plane of the base or lower surface 15 which is a liquid collecting surface. In a preferred embodiment, the angle "b" may be 14° from the lower surface 15. This slant forms an acute angled surface along the apex 91 between a first edge 92 and a second edge 93 of the prism 75. This arrangement allows for detection of the amount of water present in the base 15 by illuminating the entire length of the beveled end 78 of the prism 75 with the colored stripe, when a high level (volume) of water is present. In other words, when the water 80 reaches a level high enough to reach the second end 93, the prism will appear completely red; indicating the liquid collecting surface 15 or reservoir is full. As shown in FIG. 9, the level of the water 80 is contacting approximately half of the surface area of the beveled end 78 and will only partially illuminate the prism 75. The more water touching the beveled end 78, the greater amount of the color of the surface 85 that will be received by the eye 90 of a rack user.

In an alternate embodiment of the invention, the actuator 20 and upper surface 13 or lower surface 15 may be attached or integrally formed together. In a further alternate embodiment, the fingers 22 may be attached to the base or lower surface 15 and the upper surface 13 or lower surface 15 may act as the actuator and slide in order to pivot the fingers 22. It may be understood that when the actuator 20 is in its extended condition (FIGS. 1-3) the fingers 22 are splayed and upright for receiving articles such as cups or bottles thereon or for receiving plates or saucers between the fingers 22 supported on the upper surface 13. It may be understood that the rack 5 may be used for supporting other types of articles and for other purposes besides drying household items.

The matter set forth and the foregoing description and accompanying drawings is offered by way of illustration only and not as a limitation. While particular embodiments have been shown or descroded it will be obvious to those skilled in the art that changes in modifications may be made without departing from the broader aspects of Applicant's contribution. The actual scope of the protection sought is intended to be defined in the following claims when viewed in their proper perspective based on the prior art.

The invention claimed is:

1. A pivoting assembly for moving a finger between an extended and retracted position comprising:

fingers oriented in rows and pivotally mounted to a lower surface of a base;

an upper surface for receiving the fingers therethrough;

an extending surface and a retracting surface on the upper surface;

an actuator forming a web and the rows of fingers attached to the web, and the actuator slidably disposed between the upper and lower surfaces, the actuator, web and rows of fingers translating back and forth along the base causing the extending surface to abut the fingers in order to pivot the fingers to an extended position and the actuator causing the retracting surface to abut the fingers in order to pivot the fingers to a retracted position; and a handle attached to the actuator and the handle extending from the base for grasping in order to slidably translate the handle and the actuator.

2. The assembly of claim 1 wherein the web forming the actuator includes rotatable rods having the fingers attached thereto so that upon sliding of the actuator the rods translate and cause the fingers to pivot between the retracted and extended position.

3. The assembly of claim 1 wherein the upper surface and actuator are formed together and slide adjacent to the base.

4. The assembly of claim 1 wherein the upper surface and base form a cavity for slidingly receiving the actuator therein.

5. The assembly of claim 1 wherein the extending surface forms a semicircular side of a hole and the retracting surface forms a semicircular side of the hole opposite the extending surface and the hole is formed in the upper surface and receives the finger therein.

6. The assembly of claim 5 wherein the retracting surface is approximately collinear with the upper surface and the extending surface is oriented approximately between the upper surface and the base.

* * * * *